US005970541A

United States Patent [19]

Chiang

[11] Patent Number: 5,970,541

[45] Date of Patent: Oct. 26, 1999

[54] MODULAR MAT

[76] Inventor: John H. Chiang, 25 Oak Ridge Dr., Voorhees, N.J. 08043

[21] Appl. No.: 09/111,679

[22] Filed: Jul. 8, 1998

[51] Int. Cl.[6] ..... A47G 9/06; A47G 9/00

[52] U.S. Cl. ..... 5/420; 5/502

[58] Field of Search ..... 5/417, 420, 419, 5/500, 502, 922, 923, 496, 486

[56] References Cited

U.S. PATENT DOCUMENTS 3,801,420 4/1974 Anderson ..... 5/502 X 4,631,765 12/1986 Casey ..... 5/502 X 5,713,089 2/1998 Ferrante ..... 5/502

*Primary Examiner*—Terry Lee Melius

*Assistant Examiner*—James M. Hewitt

*Attorney, Agent, or Firm*—Caesar, Rivise, Bernstein, Cohen & Pokotilow, Ltd.

[57] ABSTRACT

A modular play mat includes a plurality of modules that have cooperating fastening means to permit the modules to be removably connected together in different configurations. The cooperating fastening means preferably are hook and loop type fasteners located on the edges of the various modules.

17 Claims, 5 Drawing Sheets

MODULAR MAT

TO ALL WHOM IT MAY CONCERN

Be it known that I, John H. Chiang, a citizen of the United States of America, residing in Voorhees, County of Camden, State of New Jersey, have made a certain new and useful invention in a MODULAR MAT of which the following is a specification.

FIELD OF THE INVENTION

This invention relates generally to a play mat, and more particularly to a modular play mat for children.

BACKGROUND ART

Play mats for children, and in particular babies, are extremely popular. These play mats generally are padded to provide a soft, cushioned surface for the baby to lie on. Preferably the play mats are colorfully decorated to provide a pleasing appearance to the child.

Prior art play mats known to applicant are unitary, padded members. The are commonly square, rectangular, or round, and, by virtue of being a unitary construction, are of a fixed size and dimension. This imposes some limitations on the use of the mat. For example, if there is a need to put the child in an area of the room having limited space that is too small for the play mat, it may not be possible to use the play mat. In addition, the fact that the play mat is of a fixed size and dimension precludes varying the size, dimension or configuration, which might have the effect of providing added visual stimulation for the child.

The present invention overcomes a number of drawbacks of the prior art, unitary play mats.

OBJECTS OF THE INVENTION

It is a general object of this invention to provide a play mat for a child that is more versatile to use than conventional play mats.

It is another object of this invention to provide a play mat that is easily adaptable for use in various areas of a room having differing amounts of space to accommodate the play mat.

It is yet another object of this invention to provide a play mat that can be used in different sizes and configurations.

It is yet another object of this invention to provide a play mat having a decorative surface appearance with visual features thereof being maintained when the play mat is used in different sizes and/or configurations.

SUMMARY OF THE INVENTION

The above and other objects of this invention are achieved in a modular play mat having a plurality of modules, said modules including fastening means to permit them to be removably connected together in different configurations.

Most preferably, each of the modules have fastening means adjacent one or more edges that are removably attachable to cooperating fastening means on one or more edges of every other module to permit the modules to be removably connected together, edge-to-edge.

Most preferably, each of the modules include edges with the cooperating fastening means being included at the edges, an upper surface having a visual presentation of an area or scene including a pathway, said pathway extending to each of the edges that include fastening means thereat. The pathway is substantially in the middle of each of the edges that include fastening means thereat, whereby the pathway of each module is a continuous extension of the pathway of any module removably connected thereto.

In a preferred form of the invention the play mat includes a plurality of modules, each including both hook-shaped fasteners and loop-shaped fasteners on opposed surfaces, with the hook-shaped fasteners of one module being removably attachable to the loop-shaped fasteners of another module.

In the most preferred form of the invention the loop-shaped fasteners on one of the opposed surfaces of the modules are loops inherently formed in a knit edging, and the hook-shaped fasteners are the male component of a VELCRO fastening system.

In the most preferred form of the invention at least one of the modules provides a finished edge that is free of any fasteners, so as to provide a smooth edge surface of the mat when this latter module(s) is (are) used.

BRIEF DESCRIPTION OF THE DRAWINGS

The above and other objects of this invention will become readily apparent from the detailed description which follows, when taken in conjunction with the accompanying drawings, wherein.

DESCRIPTION OF THE BEST MODE OF THE INVENTION

Figure 1:
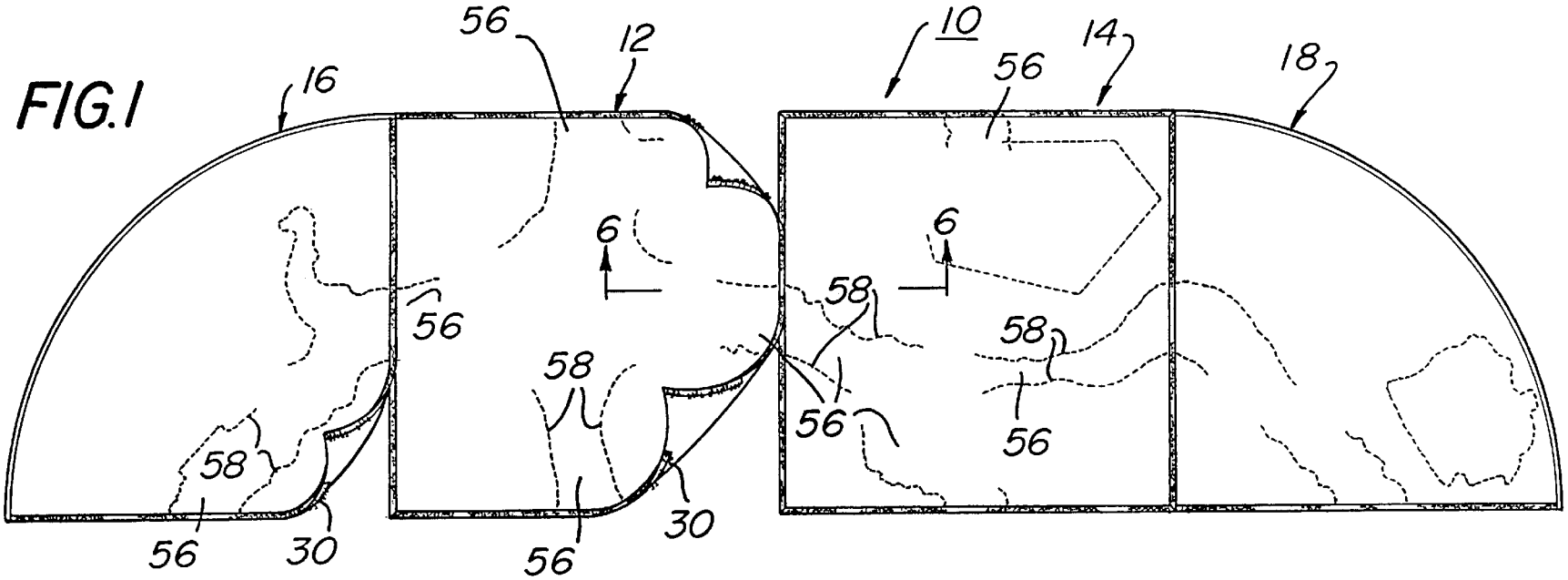
FIG. 1 is a plan view showing the modules of a play mat in accordance with this invention assembled in a predetermined pattern, and showing selected edge segments separated to illustrate the removable attachment feature of the invention.

Referring to FIG. 1, a preferred embodiment of a modular mat; preferably a play mat, is shown at 10. The preferred modular play mat includes four separate modules 12, 14, 16 and 18; two of them (12, 14) being quadrilateral (e.g., square or rectangular) and the other two (16, 18) being generally fan-shaped or pie-shaped. It should be understood that in accordance with the broadest aspects of this invention the number of modules and the shape of the modules employed in the play mat can be varied within wide limits, and does not constitute a limitation on the broadest aspects of the present invention. However, in the preferred embodiments at least three separate modules are employed.

The materials employed to form each of the modules can be varied within wide limits, depending upon the look, feel and function desired. Most desirably, each of the modules is of the same multilayer construction, although the configuration and/or dimensions may vary from module to module.

Figure 6:
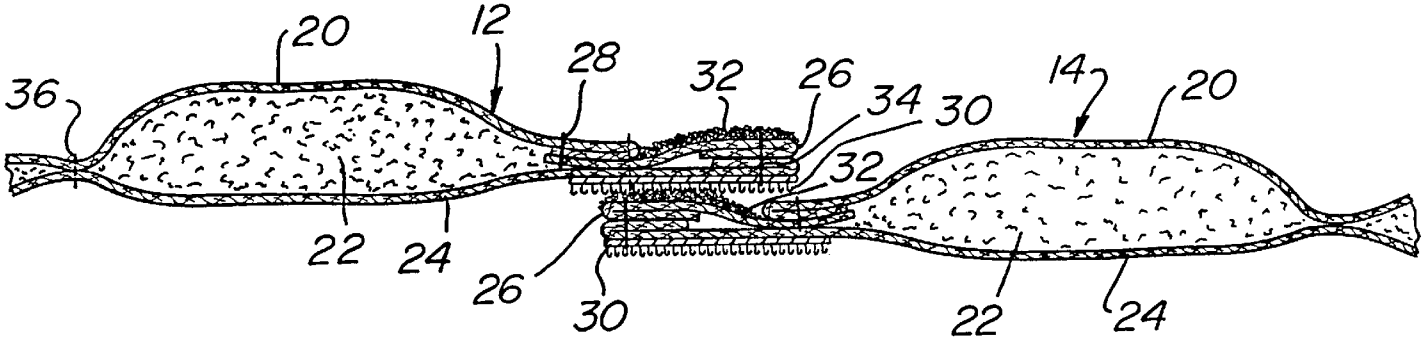
FIG. 6 is a sectional view taken along line 6—6 of FIG. 1, illustrating the removable attachment of the hooks on the edge of one module with the loops in the edge of an adjacent module, and also illustrating internal details of construction of the modules.

Referring to FIG. 6, the multilayer construction of the modules 12 and 14 is shown, it being understood that in the preferred embodiment of the invention the modules 16 and 18 are of the same multilayer construction. In the exemplary embodiment of the invention shown in FIG. 2 the modules each include a top layer 20 for supporting a child, an intermediate stuffing or padding layer 22 for adding bulk or cushioning to the structure, and a bottom fabric layer 24 for engaging the floor or other supporting surface.

The top layer 20 can be of any desired fabric, and preferably is a polyester cotton woven fabric because of its durability.

The bottom layer 24 also can be of any desired construction and most preferably is a woven polyester fabric.

The padding 22 can be of any desired construction to add cushioning properties to the product, such as a polyester fiber padding, a foam padding, or the like.

Still referring to FIG. 6, in the preferred embodiment of this invention the top edges of each module 12 and 14 include a top strip 26 that is sewn by stitching 28 to the folded edge of the top layer 20 and to the bottom layer 24, as well as to the hook-shaped fastener strips 30, e.g., VELCRO fasteners (to be described in greater detail hereinafter). Most preferably the top strip 26 is in the form of a knit fabric, most preferably a tricot polyester knit that inherently provides a loop-type upper surface 32 that is removably connectable to hook-shaped fasteners such as VELCRO hook-shaped fasteners of the type forming a part of strips 30.

Still referring to FIG. 6, it should be noted that the distal edges of the bottom layer 24 and the knit top strip 26 are folded on themselves to provide a smooth edge, and are sewn together in this condition by stitching 34. This stitching 34 also passes through the hook-shaped fastener strips 30 to secure those strips to the modules. It also should be noted that the top and bottom layers 20 and 24 are sewn together in a number of spaced apart locations (e.g. 36, 58) to thereby immobilize the padding layer 22 there between, and prevent it from shifting and/or separating within the interior of each of the modules of the play mat 10.

Figure 2:
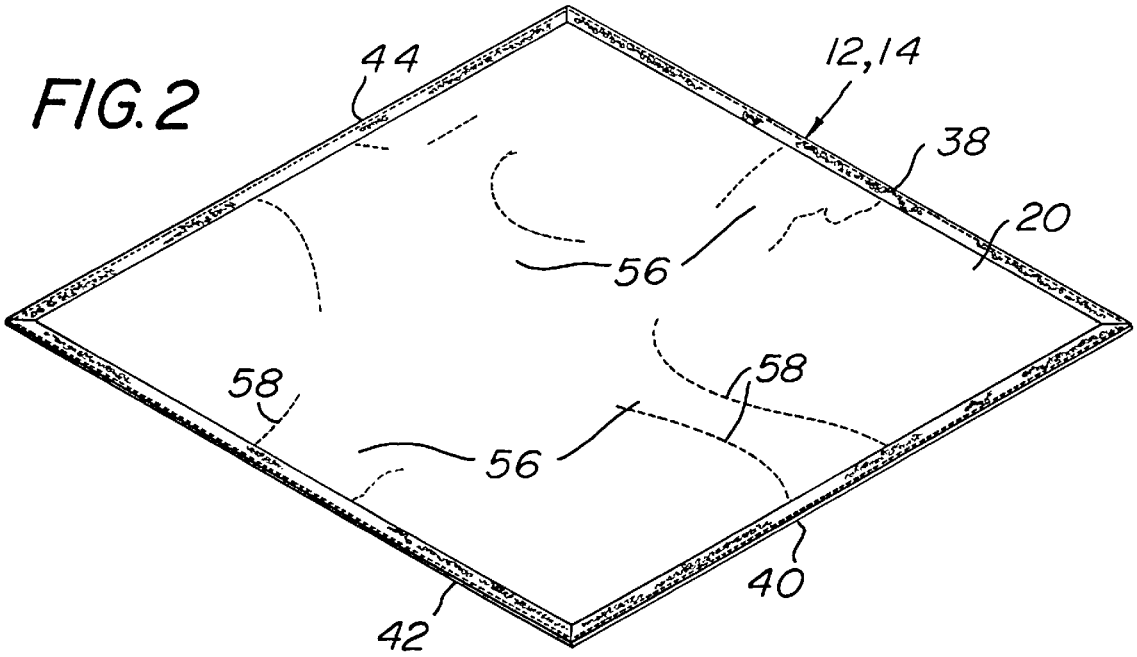
FIG. 2 is a plan view of one form of module of the play mat, in the form of a square, with edging thereof provided with loop-type fasteners, in the form of a knit selvage.
Figure 3:
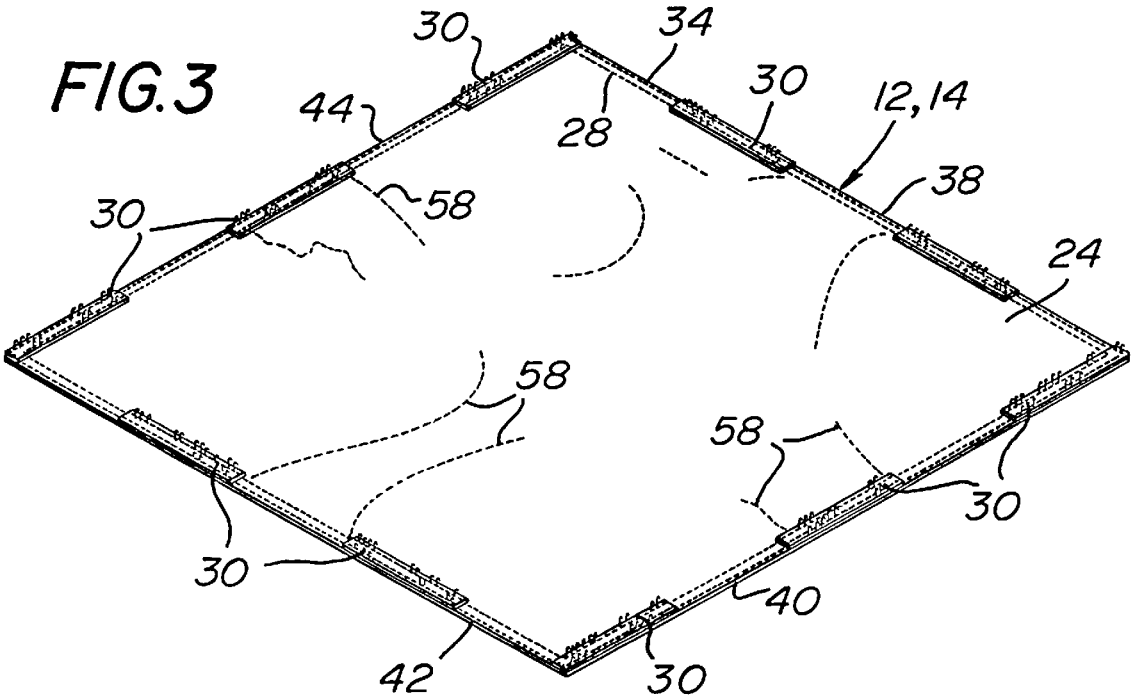
FIG. 3 is a bottom view of the form of module shown in FIG. 2, with edging including hook type fasteners thereon that are adapted to removably attach to loop-type fasteners of the type depicted in FIG. 2 but located on another module of the play mat.

As can be seen best in FIGS. 2 and 3, the four edges 38, 40, 42 and 44 of the quadrilateral module 12 and 14 are each provided with the above-described edge construction, as is shown in FIG. 6.

Referring specifically to FIG. 3, the lower surfaces of the four edges are each provided with a number of spaced apart hook-shaped fastener strips 30, with each of the four corners including a segment of at least one strip 30 thereat. In other words, each of the distal corners includes a VELCRO fastening element adapted to removably attach to the upper knit surface 32 of the top edge strip 26 of an adjacent module.

Figure 4:
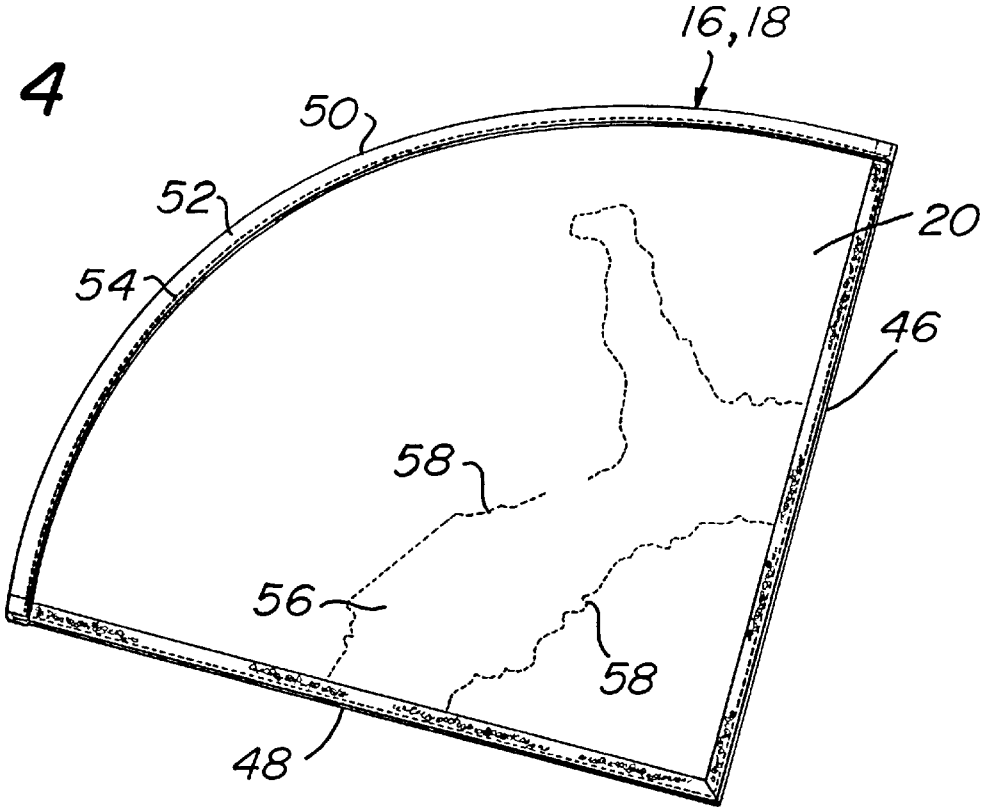
FIG. 4 is a plan view of another form of module of the play mat of this invention, in the form of a generally pie-shaped member, having loop-type fasteners in the form of a knit selvage on only the two straight edges thereof.
Figure 5:
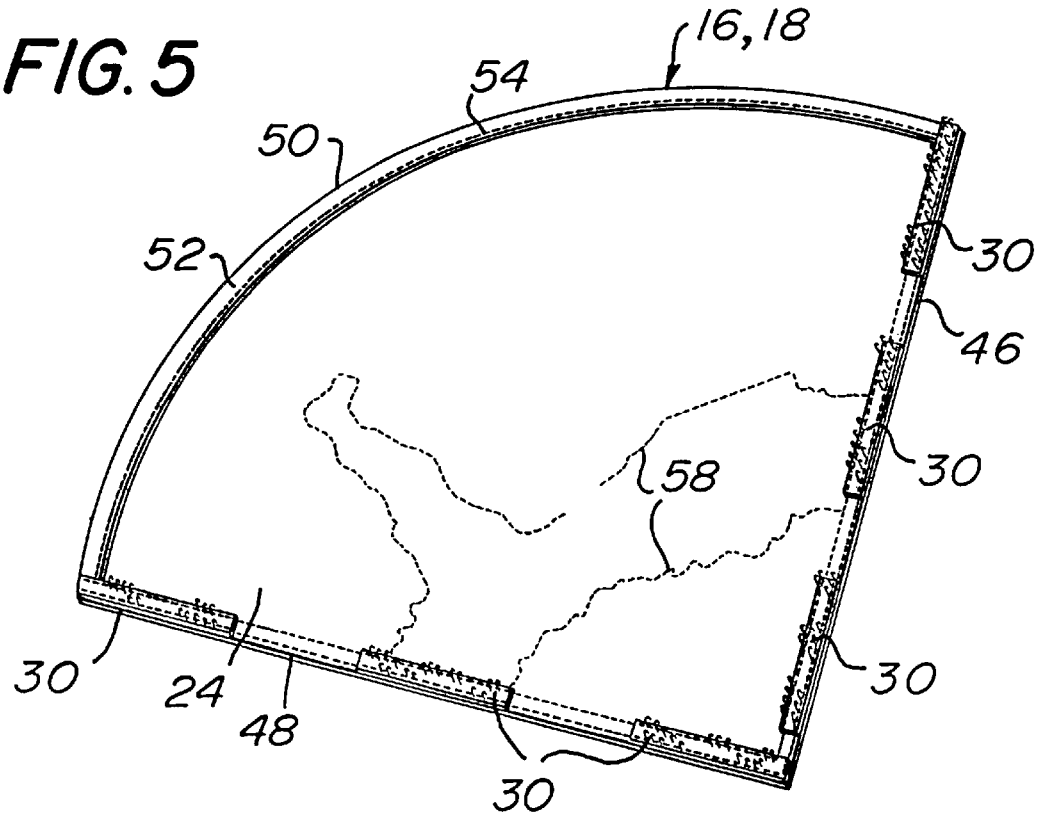
FIG. 5 is a bottom view of the form of module shown in FIG. 4, with edging including hook type fasteners on only the two straight edges thereof.

Referring specifically to FIGS. 4 and 5, the top and bottom views, respectively, of the fan-shaped modular elements 16, 18 are shown. These fan-shaped modular elements include two linear edges 46, 48 and one generally curved edge 50. In the preferred embodiment of the invention each of the fan-shaped modules 16, 18 is of a three layer construction identical to the modules 12 and 14, and the linear edges 46, 48 are of the identical construction as the four edges 38, 40, 42 and 44 of the modules 12, 14. However, in the preferred construction, the curved edge 50 is intended to be an outer margin of an assembled modular mat, and for that reason, does not include any fastening means. Specifically, the curved edge 50 preferably is provided by a woven fabric 52 having a smooth, satin finish. This woven fabric is folded about the aligned edges of the top and bottom layers 20 and 24, then folded on itself to provide smooth edges, and finally sewed to the top and bottom layers by suitable stitching 54.

Referring to FIGS. 1–5, each of the modules includes a visual depiction of an area or scene, e.g., a farm scene, country scene, town scene, etc., on the upper surface of the top layer 20, including a visually discernable pathway 56 (e.g., distinguished by a specific color). As illustrated, the pathway 56, in addition to being distinguishable by color, also includes suitable stitching 58 along both side edges thereof This stitching 58 actually passes through the upper and lower layers 20 and 24 to aid in immobilizing the interior padding 22 (FIG. 6) to prevent the padding from excessively shifting and/or breaking apart within the interior of the modules.

Figure 7:
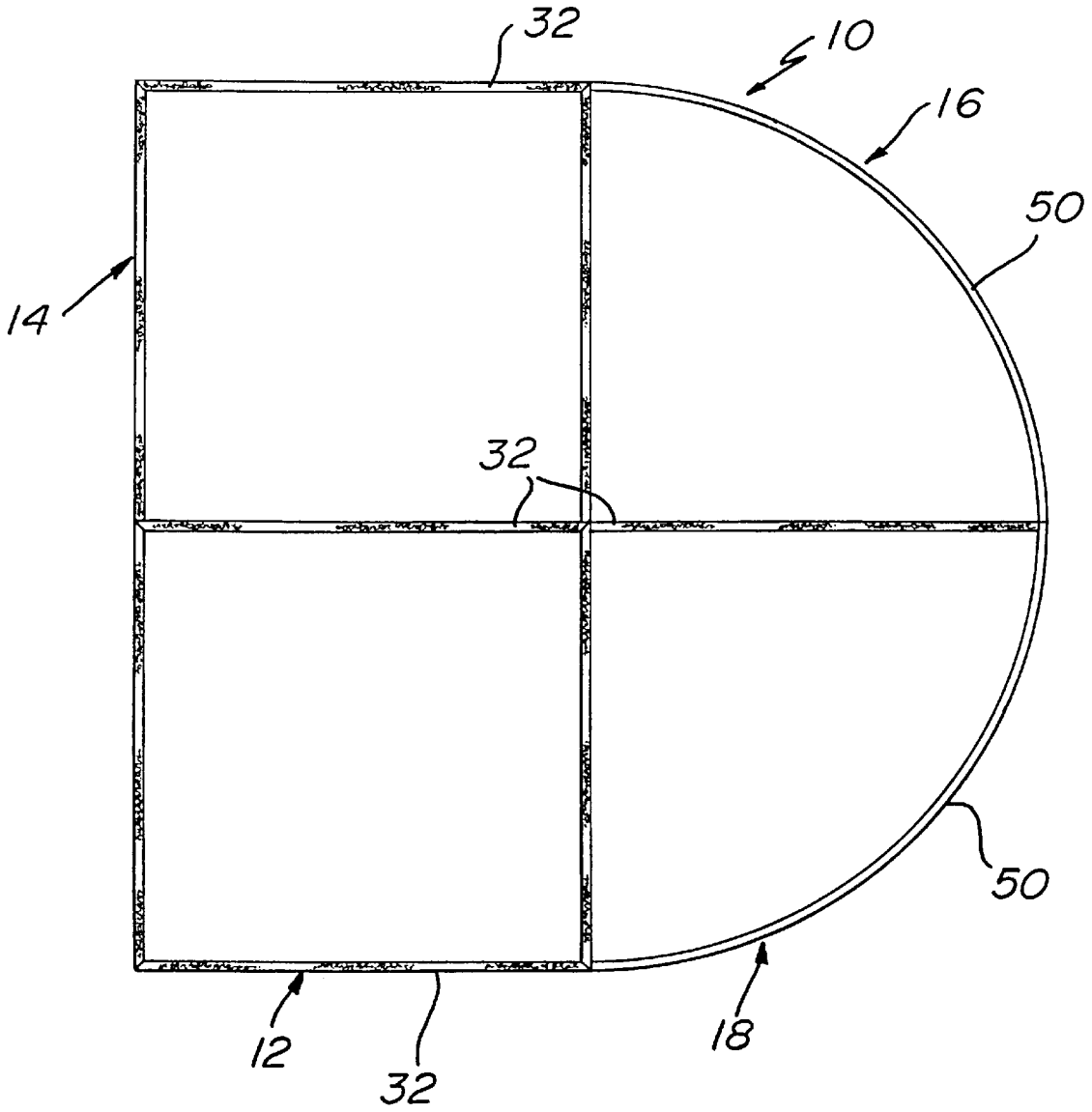
FIG. 7 is a top plan view showing the modules of the play mat arranged in a pattern different from that illustrated in FIG. 1.
Figure 8:
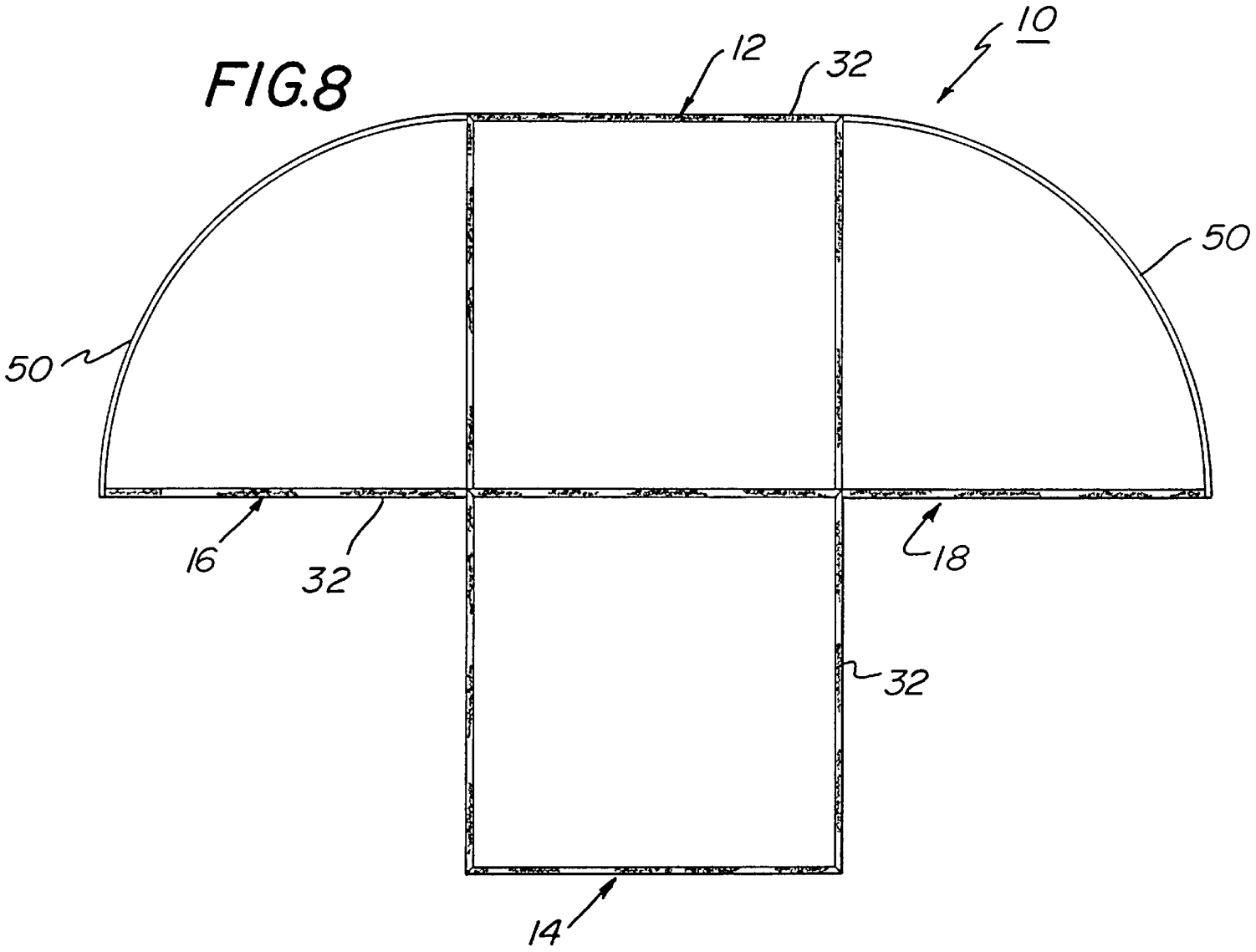
FIG. 8 is a top plan view showing the modules of the play mat arranged in yet another pattern.

Still referring to FIGS. 1–5, the pathways 56 extend to each of the module edges that include fastening means thereon. Most preferably, the pathways meet the edges substantially in the middle of each edge, so that when the modules are connected edge-to-edge the pathways 56 of the various modules will be aligned to create a continuous pathway from module to module. This can be seen best in FIG. 1, where the four modules are connected edge to edge in a linear array. However, it should be understood that such a continuous pathway from module to module is established regardless of the array in which the modules 12, 14, 16 and 18 are connected to each other. For example, the continuous pathway will be established when the modules are removably attached in the arrays shown in both FIG. 7 and FIG. 8, as well as all other possible arrays in which the entire length of an edge of one module is removably connected to the entire length of an edge of an adjacent module through the removable fastening means provided on said removably connected edges.

It should be understood that in the preferred embodiment of the invention only the upper surface of the top layer 20 includes the visual depiction of the area or scene, except for the existence of stitching 58, which extends through the bottom layer 24.

As note earlier, in the most preferred embodiment of this invention the modular play mat includes four units or modules; two of the modules 12, 14 being quadrilateral; preferably square, and the remaining two modules 16, 18 being fan-shaped or pie-shaped units. These modules can be connected in a variety of different geometric arrangements depending upon the desires of the user and/or the space available for receiving the mat.

Although four modules preferably are employed in this invention it is within the scope of the invention to include a lesser number of modules or a greater number of modules. However, from a practical standpoint the play mat should include at least three modules, and more practically, at least four modules.

Without further elaboration, the foregoing will so fully illustrate this invention that others may, by applying current or future knowledge, readily adapt the same for use under various conditions of service.

What I claim as my invention is:

1. A modular play mat including a plurality of modules, said modules comprising:

cooperating fastening means to permit said modules to be removably connected together in different configurations;

edges at which said cooperating fastening means are arranged; and an upper surface having a visual presentation of an area or scene including a pathway, said pathway extending to each of said edges, said pathway being substantially in a middle of each of said edges, whereby the pathway of each of said modules is a continuous extension of the pathway of any other of said modules removably connected thereto said pathway being visually discernable from a balance of said area or scene by virtue of at least one of a color change, a shading change, a contour change and a texture change.

2. The modular play mat of claim 1, wherein each of said modules includes at least one of said edges and said cooperating fastening means.

3. The modular play mat of claim 1, wherein each of said modules comprises at least two of said edges, said at least two edges being linear, and each of said modules further comprises a lower surface opposed to said upper surface, and wherein said cooperating fastening means are provided on both said opposed upper and lower surfaces adjacent said at least two linear edges with the cooperating fastening means on the upper surface of each of said modules being removably attachable to the fastening means on the lower surface of another of said modules.

4. The modular play mat of claim 1, wherein each of said modules has said cooperating fastening means adjacent one or more of said edges that are removably attachable to said cooperating fastening means adjacent one or more of said edges of every other one of said modules to permit the modules to be removably connected together, edge-to-edge.

5. The modular play mat of claim 1, wherein each of said modules further comprises a lower surface opposed to said upper surface, and said cooperating fastening means comprises hook-shaped fasteners and loop-shaped fasteners on opposed surfaces, said hook-shaped fasteners of each of said modules being removably attachable to the loop-shaped fasteners of every other one of said modules.

6. The modular play mat of claim 5, wherein the hook-shaped fasteners are on said upper surface and the loop-shaped fasteners are on said lower surface, or said hook-shaped fasteners are on said lower surface and the loop-shaped fasteners are on the upper surface.

7. The modular play mat of claim 6, wherein said hook-shaped fasteners are on the lower surface adjacent one or more of said edges of each of said modules and the loop-shaped fasteners are on the upper surface adjacent one or more of said edges of each of said modules.

8. The modular play mat of claim 6, wherein the loop-shaped fasteners on one of the upper and lower surfaces are provided by a knit fabric edging.

9. The modular play mat of claim 7, wherein the loop-shaped fasteners on the upper surface are provided by a knit fabric edging.

10. The modular play mat of claim 2, wherein at least one of said plurality of modules includes a finished edge that is free of fastening means so as to provide a smooth edge surface of the mat.

11. The modular play mat of claim 1, including at least four modules, at least two of said four modules being quadrilaterals and at least two of said four modules being pie-shaped members having two linear edges and a curved edge.

12. The modular play mat of claim 11, wherein each of said at least four modules includes opposed upper and lower surfaces, said fastening means including hook-shaped fasteners and loop-shaped fasteners on opposed surfaces of all four edges of said at least two quadrilateral modules and on the two linear edges of said at least two pie-shaped modules, said hook-shaped fasteners of each module being removably attachable to the loop-shaped fasteners of every other module.

13. The modular play mat of claim 12, wherein the hook-shaped fasteners are on one of said upper and lower surfaces and the loop-shaped fasteners are on an opposite one of said upper and lower surfaces.

14. The modular play mat of claim 13, wherein the hook-shaped fasteners are on the lower surface of each said module and the loop-shaped fasteners are on the upper surface of each said module.

15. The modular play mat of claim 13, wherein the loop-shaped fasteners on one of the upper and lower surfaces are provided by a knit fabric edging.

16. The modular play mat of claim 14, wherein the loop-shaped fasteners on the upper surface are provided by a knit fabric edging.

17. The modular play mat of claim 12, wherein the curved edge of each of said at least two pie-shaped modules is free of fastening means and provides a smooth edge surface of the mat.

* * * * *